United States Patent [19]

Nozaka et al.

[11] Patent Number: 4,922,821

[45] Date of Patent: May 8, 1990

[54] CLEANING SYSTEM OF PRINTING PRESS

[75] Inventors: Yoshiki Nozaka; Tetsuro Katsuta; Hiroshi Miyama, all of Tokyo, Japan

[73] Assignee: Dai Nippon Insatsu Kabushiki Kaisha, Japan

[21] Appl. No.: 394,269

[22] Filed: Aug. 15, 1989

Related U.S. Application Data

[63] Continuation of Ser. No. 77,870, Jul. 27, 1987, abandoned.

[30] Foreign Application Priority Data

| | | | |
|---|---|---|---|
| Aug. 2, 1986 | [JP] | Japan | 61-182553 |
| Aug. 2, 1986 | [JP] | Japan | 61-182554 |
| Aug. 2, 1986 | [JP] | Japan | 61-182555 |
| Oct. 8, 1986 | [JP] | Japan | 61-237858 |

[51] Int. Cl.[5] ..... B41F 35/00; B41L 41/00

[52] U.S. Cl. ..... 101/425; 101/156; 101/168; 101/423

[58] Field of Search ..... 101/417, 418, 156, 168, 101/423, 425

[56] References Cited

U.S. PATENT DOCUMENTS

| | | | |
|---|---|---|---|
| 907,577 | 12/1908 | Diehl | 101/423 X |
| 1,197,182 | 9/1916 | Chisholm | 101/137 |
| 2,225,529 | 12/1940 | Beall | 101/227 |
| 3,126,826 | 3/1964 | Fischer | 101/420 |
| 3,592,136 | 7/1971 | Selman | 101/425 |
| 3,763,778 | 10/1973 | Sills et al. | 101/423 X |
| 3,956,987 | 5/1976 | Alix | 101/425 |
| 4,135,448 | 1/1979 | Moestue | 101/425 |
| 4,232,604 | 11/1980 | Waizmann | 101/425 |
| 4,389,936 | 6/1983 | Jaffa et al. | 101/425 X |
| 4,433,623 | 2/1984 | Beckim | 101/425 X |
| 4,537,130 | 8/1985 | Theilacker | 101/425 |
| 4,651,644 | 3/1987 | Kaempfe et al. | 101/425 X |

FOREIGN PATENT DOCUMENTS

| | | | |
|---|---|---|---|
| 476011 | 8/1951 | Canada | 101/425 |
| 2538105 | 4/1976 | Fed. Rep. of Germany | 101/425 |
| 86757 | 7/1981 | Japan | 101/425 |
| 1567893 | 5/1980 | United Kingdom | 101/425 |

OTHER PUBLICATIONS

Xerox Disc. Journ., Vock, "Cleaning Device", vol. 4, No. 2, Mar./Apr. 1979, pp. 263–264.

Xerox Disc. Jour., "Web Cleaning System", Sonnenberg, vol. 4, No. 6, Nov./Dec. 1979, p. 707.

*Primary Examiner*—Edgar S. Burr

*Assistant Examiner*—Tonya Lamb

*Attorney, Agent, or Firm*—Arnold, White & Durkee

[57] ABSTRACT

In a combination of a cleaning device of a cylinder of an offset sheet-fed press and a cylinder to be cleaned, the cleaning device is provided with a blade member as a cleaning cloth pressing member against the cylinder to be cleaned, the blade member having a relatively sharp edge pressing the cleaning cloth against the cylinder. The cylinder is an impression cylinder provided with sheet holding grippers projecting over the outer peripheral surface of the impression cylinder. The grippers are protected so as not to directly contact the cleaning cloth under the pressed condition by locating cam members to cover the grippers or by locating a cleaning device moving mechanism in a manner such that when the grippers approach the blade member during the rotation of the impression cylinder, the cleaning device is moved away therefrom.

6 Claims, 5 Drawing Sheets

CLEANING SYSTEM OF PRINTING PRESS

This is a continuation of application Ser. No. 07/077,870 filed July 27, 1987, now abandoned.

BACKGROUND OF THE INVENTION

This invention relates to a cleaning system of a printing press and more particularly to a combination of an impression cylinder and a cleaning unit therefor of an offset sheet-fed press.

An offset printing press of general type comprises in combination of a plate cylinder, a blanket cylinder, an impression cylinder and intermediate cylinder which are arranged to be mutually rotatable in contacting conditions, a printed paper recovery unit, an inking unit, a cleaning unit and the like.

With the offset printing press of the character described above, in an actual printing operation, printing liquid such as ink is transferred on an outer peripheral surface of the respective cylinders, for example, impression cylinder through the blanket cylinder, and dirt or paper dust or the like will be adversely stuck thereon during the printing operation. The dirt or dust thus stuck on the impression cylinder surface will form protrusions thereon which obstruct precise printing operation and make it impossible to obtain clearly printed materials.

Under these circumstances, several kinds of cleaning devices for cleaning the respective cylinders, for example, for the blanket cylinder has been developed, and a typical type of these cleaning devices or units comprises a magazine roll around which a cleaning cloth or the like is wound, a used cleaning cloth take-up roll, a cleaning liquid supply means for applying the cleaning liquid to the cleaning cloth, and a pressing member such as pneumatic pad for pressing the cleaning cloth against the outer peripheral surface of the cylinder. In the actual cleaning, the cylinder is rotated and the cleaning cloth is stepwisely drawn out under the pressed condition against the cylinder by suitable means.

The cleaning operation involves the following disadvantages or drawbacks.

(a) The draw-out of the cleaning cloth under the pressed condition requires much force for drawing out the same and it is also required for the cleaning cloth to apply a considerably large tension. This requires some strengthening means for a drive system and hence the whole structure of the press to impart the stiffness thereto, which results in enlargement and heavy weight of the whole structure of the press, thus being complicated and noneconomical.

(b) In a case where it is required to remove the cleaning cloth from the impression cylinder, the cleaning cloth pressing means has to be everytime moved in a direction apart from the cylinder, so that the pressing means and hence the press itself will be complicated.

In another aspect, however, regarding the cleaning of the impression cylinder which are generally provided with hook-shaped grippers for gripping a paper sheet in a condition of projecting outwardly from the outer peripheral surface of the impression cylinder, the location of these grippers may provide the following defects or drawbacks in the cleaning operation.

(c) Because of the projection of the grippers, it is considerably difficult to clean the area of the impression cylinder near the projecting grippers.

(d) The projecting grippers may damage the cleaning cloth during the rotation thereof under the pressed condition by means of such as pressing pad.

(e) The grippers may themselves be damaged during the rotation of the impression cylinder, which results in the damage of the offset press.

Taking the above-mentioned defects or drawbacks into consideration, the cleaning of the respective cylinders, particularly impression cylinder, is often carried out manually. Such manual cleaning working is however undertaken in a narrow space between the respective cylinders and various printing units under the rotating condition of the cylinders, thus being dangerous and a desirable cleaning effect was not expected. These drawbacks require as a consequence long cleaning time and result in the reduction of the production efficiency of the offset printing press.

SUMMARY OF THE INVENTION

An object of this invention is to substantially eliminate the defects or drawbacks of prior art technique described hereinabove and to provide an improved cleaning device for a cylinder, particularly an impression cylinder, of an offset sheet-fed press to attain the high cleaning effect.

Another object of this invention is to provide a cylinder cleaning device of the press provided with a blade member as means for pressing a cleaning cloth against the cylinder.

A further object of this invention is to provide an impression cylinder of an offset sheet-fed press provided with a mechanism for escaping grippers of the cylinder for preventing the grippers from directly contacting the cleaning cloth in operative association with the cleaning device, and particularly provide cam means secured to the grippers for escaping the same during the cleaning operation.

According to this invention, these and other objects can be achieved by providing a device for cleaning a cylinder of an offset press comprising a support frame, a magazine roll around which a cleaning cloth is wound up and having a rotation shaft supported by the support frame, a take-up roll around which a used cleaning cloth is taken up and having a rotation shaft supported by the support frame, a pressing member attached to the support frame at a portion between the magazine roll and the take-up roll and adapted to press the cleaning cloth against a cylinder to be cleaned, the pressing member comprising a blade member having a longitudinal length substantially equal to a width of the cleaning cloth contacting to the cylinder, a cleaning liquid supply unit attached to the support frame for supplying cleaning liquid to the cleanig cloth, and a mechanism for moving the support frame apart from the cylinder.

In a specific embodiment according to this invention, there is provided a combination of a cleaning device and a cylinder to be cleaned of an offset sheet-fed press comprising a cleaning device of the character described directly hereinabove, and an impression cylinder to be cleaned which is provided with sheet holding grippers projecting over a peripheral surface of the impression cylinder and mounted on a shaft of the grippers so as to cover the grippers thereby to prevent the grippers from directly contacting the cleaning cloth.

In a preferred modification of this specific embodiment, there is provided a mechanism for moving the cleaning device apart from the impression cylinder when the grippers approaches the pressing member during the rotation of the impression cylinder.

BRIEF DESCRIPTION OF THE DRAWINGS

In the accompanying drawings.

DESCRIPTION OF THE PREFERRED EMBODIMENTS

Before the disclosures of preferred embodiments of this invention, for clear understanding of the nature and character of the invention, the background art or the like will first be described hereunder in conjunction with the accompanying drawings.

Figure 1:
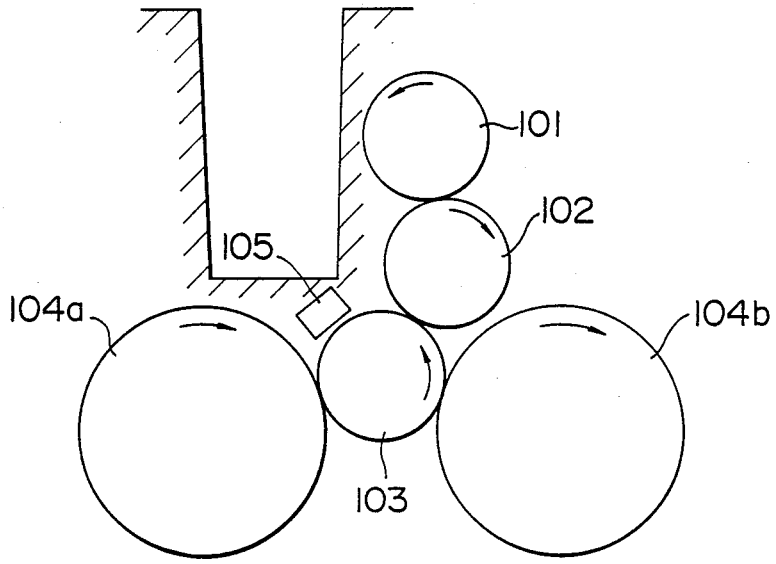
FIG. 1 is a brief illustration of an arrangement of respective cylinders of an offset sheet-fed press.

FIG. 1 shows a brief arrangement of an offset printing press of one kind which comprises a plate cylinder 101, a blanket cylinder 102 in rotatable engagement with the plate cylinder 101, an impression cylinder 103 in rotatable engagement with the blanket cylinder 102, and intermediate cylinders 104*a* and 104*b*, which are mutually rotatable in directions as shown by arrows in FIG. 1. The offset press further comprises an inking device, not shown, a sheet-fed apparatus, not shown, an impression cylinder cleaning device 105 etc. which are operatively associated with the cylinders described above.

With the arrangement of the typical offset press described above, although only the impression cylinder cleaning device is illustrated with the reference numeral 105, other cleaning devices are usually provided for the respective cylinders, and for example, roller-type, brush-type and cleaning-cloth-type cleaning device for the blanket cylinder have widely been known and developed.

The cleaning operation for the impression cylinder 103, however, has not effectively carried out manually because of the reason described hereinbefore.

Figure 11:
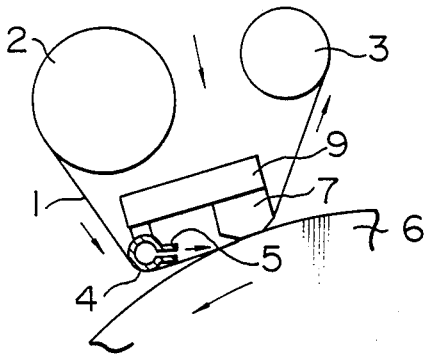
FIG. 11 PRIOR ART
FIG. 11 is a cross sectional side view of a cleaning device according to prior art for cleaning a cylinder of an offset press.

FIG. 11 is a brief illustration of an impression cylinder cleaning device of one prior type, i.e. cleaning-cloth-type, which has been used for eliminating the manual cleaning operation for the impression cylinder.

Referring to FIG. 11, a cleaning cloth 1 wound around a magazine roll 2 is fed for cleaning the outer peripheral surface of an impression cylinder 6 and then wound up around a take-up roll 3. A cleaning device 9 is located between the magazine roll 2 and the take-up roll 3 and comprises a cleaning liquid supply pipe 4 provided with nozzles 5 through which a cleaning liquid is supplied to the cleaning cloth 1 and a pressing means 7 such as a pneumatic pad 7 in FIG. 11 for pressing the cleaning cloth 1 against the outer peripheral surface of the impression cylinder 6.

Under the pressed condition of the cleaning cloth 1, the impression cylinder 6 is rotation and the cleaning cloth 1 is stepwisely fed by drive means, not shown. As the pressing means 7 is utilized a cushion such as sponge, a pressing roller or the like instead of pneumatic pad.

With the cleaning device of the character described above, however, in use of any type of pressing means described above, a pressed or pressing area between the cleaning cloth 1 and the impression cylinder 6 is likely made wide in accordance with the nip width, and this fact exposes drawbacks or disadvantages described hereinbefore.

Namely, the movement of the cleaning cloth 1 under the pressed condition requires a considerably large driving force, which results in the enlargement of the driving mechanism and hence the whole structure of the printing press. The tension applied to the cloth also requires the mechanical strength of the whole structure. Moreover, it is troublesome to move or shift the pressing means at a time when the cleaning cloth is removed from the impression cylinder.

In addition, since the impression cylinder of an offset sheet-fed press is usually provided with hook-shaped sheet grippers projecting outwardly from the outer peripheral surface of the impression cylinder, the existance of the projecting grippers makes it difficult to effectively clean the area near the projections of the impression cylinder.

Figure 2:
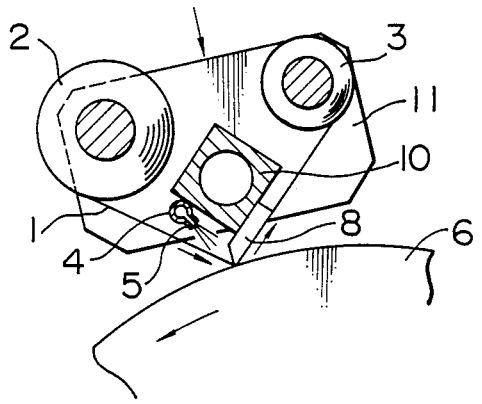
FIG. 2 is a cross sectional side view of a cleaning device according to this invention for cleaning a cylinder of the press shown in FIG. 1.
Figure 3:
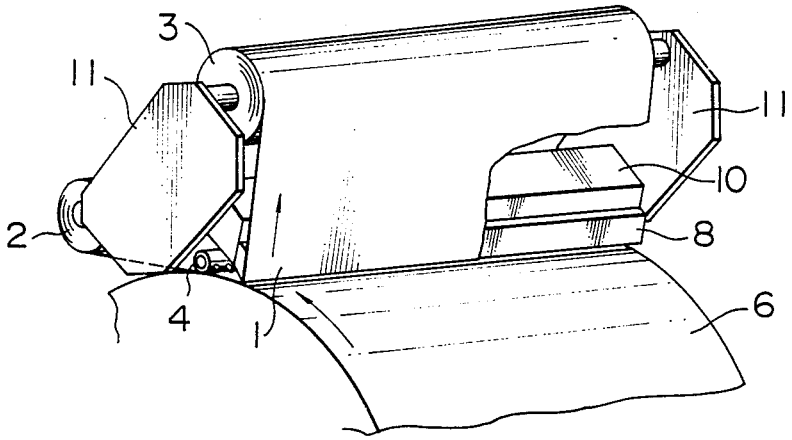
FIG. 3 is a perspective view, partially broken away, of the cleaning device shown in FIG. 2.

FIGS. 2 and 3 are illustrations of a cleaning device for a cleaning cylinder, particularly an impression cylinder, of an offset printing press according to this invention to substantially eliminate the defects or drawbacks encountered in the prior art technique, and like reference numerals are added to elements corresponding to those shown in FIG. 11.

Referring to FIGS. 2 and 3 respectively as a cross sectional side view and a perspective view of the cleaning device, the cleaning cloth 1 wound up around the magazine roll 2 is stepwisely drawn out by operation of driving means, not shown, and taken up by the take-up roll 3 and these rolls 2 and 3 are rotated by driving means operatively connected to shafts of the respective rolls, these shafts being supported by a frame 11. A support member 10 also supported by the frame 11 is located between the respective rolls 2 and 3 and supports the cleaning liquid supply pipe 4 having nozzles 5 for jetting the cleaning liquid towards the cleaning cloth near the impression cylinder 6. The support member 10 further supports a blade 8 as a pressing means for pressing the cleaning cloth 1 against the impression cylinder 6.

The use of the blade 8 having a longitudinal length substantially equal to that of a cleaning cloth to be used and a sharp edge contacting the rear surface of the cleaning cloth 1 at an angle of about 45° eliminates the contacting area therebetwen in comparison with the use of the other pressing means such as a pneumatic pressing pad used in the prior technique to thereby improve the cleaning effect. In addition, it is of course desired to use the blade made of a material not to be affected with a liquid or solvent used as the cleaning liquid.

Figure 4:
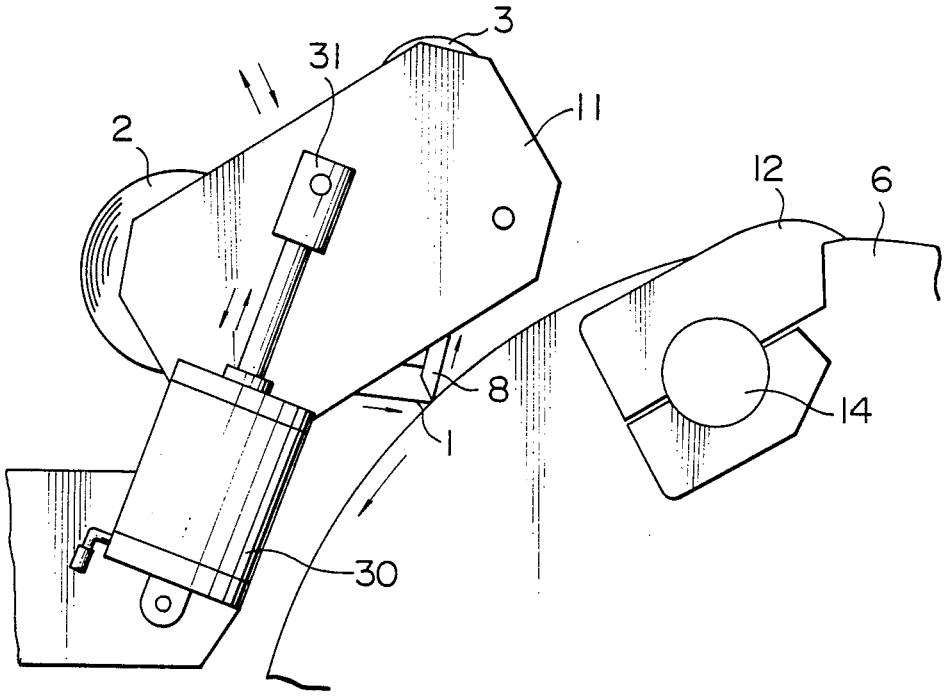
FIG. 4 is a side view showing a pneumatic cylinder assembly for moving the cleaning device such as shown in FIG. 2.

It is to be noted that although the cleaning device according to this invention is further provided with a pneumatic cylinder means as a unit for moving the cleaning device from the impression cylinder for preventing the device from contacting the impression cylinder during the high speed rotation thereof and a one-way clutch and air cylinder means for stepwisely drawing out and taking up the cleaning cloth, these units and mechanisms are per so well known in this art of field, so that the details thereof are substantially eliminated herein, and one example of only the pneumatic cylinder assembly for moving the cleaning device will be described herein in conjunction with FIG. 4.

Referring to FIG. 4, a cylinder portion of a pneumatic cylinder assembly 30 is attached to a printing machine frame, not shown, and a plunger head 31 of the assembly is in turn secured to the frame 11 of the cleaning device. The pneumatic cylinder 30 lifts pivotably the cleaning device, when it is extended, to move the device away from the impression cylinder 6 and lowers the same by gravity to contact the cylinder to be cleaned. The frame 11 is usually constructed to be rotatable about a pivot, not shown, in association with the operation of the pneumatic cylinder 30.

In one preferred embodiment according to this invention, the respective constructional means or elements have characters and natures such as follows.

Cleaning Cloth

The cleaning cloth 1 is of the thickness of about 0.3 mm and possessed with a solvent, as cleaning liquid, resisting ability, and is made of a non-woven cloth provided with lipophilic and hydrophilic characters.

Magazine Roll

The magazine roll 2 is provided with a mechanism for easily mounting the rolled cloth as it is and a brake means capable of preventing the cleaning cloth from loosening when the cleaning cloth is stepwisely drawn out from the magazine roll shaft.

Take-up Roll

The take-up roll 3 is provided with a mechanism for easily removing the used rolled cloth as it is and is rotated in a direction reverse to the rotating direction of the impression cylinder to be cleaned.

Pressing Blade

The pressing means, which may be in the shape of a blade 8 having an edge, possesses a nature not to be affected by the solvent used as the cleaning liquid such as aluminum. The blade has a thickness of about 5 mm and is pressed against the impression cylinder with the pressure of about 350 g/cm$^2$ to 700 g/cm$^2$. The blade is also provided with a front edge having an inclination angle of about 20° to 60° for effectively pressing the cleaning cloth against the impression cylinder.

Cleaning Liquid Supply Device

The cleaning liquid supply pipe 4 is generally provided with a plurality of nozzles 5 for respectively jetting the solvent and the water so as to supply the cleaning liquid evenly to the cleaning cloth throughout the axial length of the impression cylinder. It is desired for the jetting amount of the cleaning liquid to be sufficient for wetting the cleaning cloth (for example, in this embodiment, about 20 ml to 50 ml per one jetting operation with respect to the blade having a width of 1362 mm).

Support Member

The support member 10 positively supports the blade 8 so that the blade can always press the cleaning cloth with a constant pressure and at a constant angle. The support member 10 also supports the cleaning liquid supply device so that the cleaning liquid can be jetted to the cleaning cloth always at a constant angle of the nozzles.

As described hereinbefore, according to one preferred embodiment of this invention, the use of the blade as a cleaning cloth pressing means reduces the contacting area between the cleaning cloth and the cylinder, whereby the friction force caused therebetween can be effectively reduced, and moreover, the cleaning cloth can be taken up by the take-up roll without applying large tension to the cloth, thus simplifying the take-up mechanism.

The construction in which the cleaning cloth can be drawn out by rotating the take-up roll in the direction reverse to the rotating direction of the cylinder to be cleaned can highly improve the cleaning efficiency.

The fact that there is no need for removing the pressing blade from the cylinder in case of winding up the used cleaning cloth makes it possible to considerably reduce the cleaning time.

In addition, the use of the blade as the pressing means makes compact the structure thereof in comparison with the conventional one such as a pneumatic pressing pad, thus being economical.

Furthermore, in case of cleaning the impression cylinder, since the pressing blade is provided with a relatively narrow front edge, the area of the outer peripheral surface near the projecting grippers of the impression cylinder can be effectively cleaned.

In the foregoing descriptions, although the use of the blade means as the cleaning cloth pressing means is referred to for effectively improving the cleaning effects of the cylinder, particularly the impression cylinder, of an offset press, this cleaning effect will be further increased, by providing an improved structure of a gripping mechanism of the impression cylinder of an offset sheet-fed press.

Figure 5:
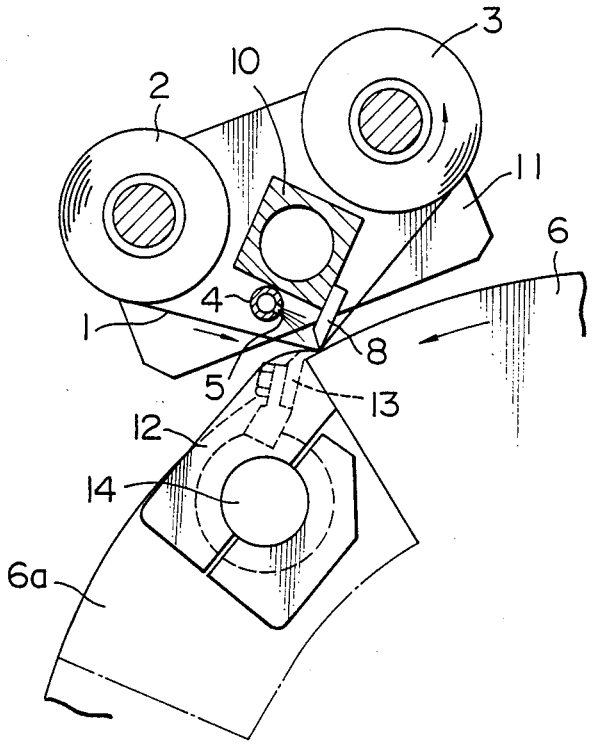
FIG. 5 is a cross sectional side view showing the arrangement of the combination of the cleaning device and an impression cylinder to be cleaned according to this invention.
Figure 6:
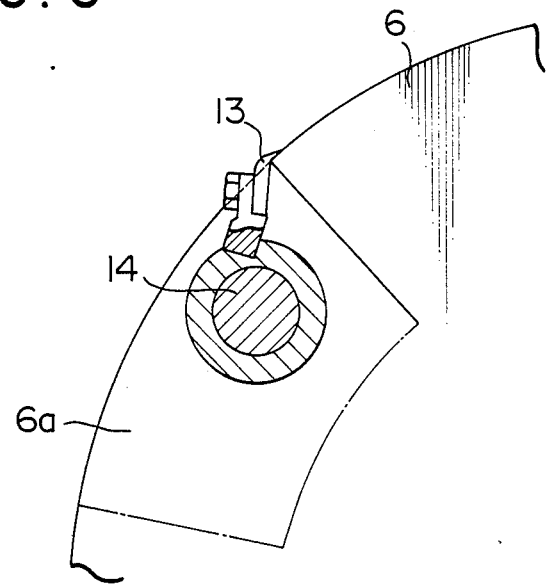
FIG. 6 is a brief cross sectional side view showing grippers located in the impression cylinder in association with cam means according to this invention.

FIG. 5 shows a cross sectional side view of the cleaning device shown in FIG. 2 in operative association with an impression cylinder provided with an improved sheet gripping mechanism and FIG. 6 is also a cross sectional side view showing the gripping mechanism of FIG. 5, in which like reference numerals are added to elements or means corresponding to those shown in FIGS. 1 through 3.

Referring to FIGS. 5 and 6, a recess **6*a* is formed in the impression cylinder 6 along the axial direction therof for accommodating hook-shaped grippers 13 mounted on a gripper shaft 14, on which at least two escape cams 12, i.e. cam plates, are also mounted near the grippers 13. The escape cam 12 has an outer configuration larger than that of each gripper and is usually made of reinforced plastic or light metal. In a modification, a cam is utilized of another type having a structure such that the cleaning cloth 1 can smoothly get over the gripper portion even in contact with the front ends of the grippers when the cleaning of the impression cylinder is carried out by moving the cleaning cloth 1**.

According to the location of the cam means mounted on the shaft of the grippers, in case of cleaning the impression cylinder, a portion of the cleaning cloth pressed against the impression cylinder is raised outwardly from the grippers and hence the impression cylinder, thus preventing the cleaning cloth from being damaged by the grippers. With this embodiment utilizing the cam plates, although a pneumatic pad or the like can be used as cleaning cloth pressing means, it is of course to be noted that the use of the blade member as the pressing means makes it possible to substantially completely clean the portion of the impression cylinder near the location of the grippers.

In this embodiment, the cleaning device inclusive of the pressing means and the other units or members such as the cleaning device removing unit having substantially the same constructions as those described with respect to the first embodiment will be utilized and the actual cleaning operation carried out by these members and units will also substantially the same as that described hereinbefore.

In another aspect of this invention, there is provided an improved mechanism capable of shifting the pressing means or cleaning device for pressing the cleaning cloth against the impression cylinder of the offset sheet-fed press when the grippers located in the impression cylinder approaches the pressing means of the character described hereinbefore during the rotation thereof to prevent the grippers, pressing means and cleaning cloth from being damaged mutually.

Figure 7:
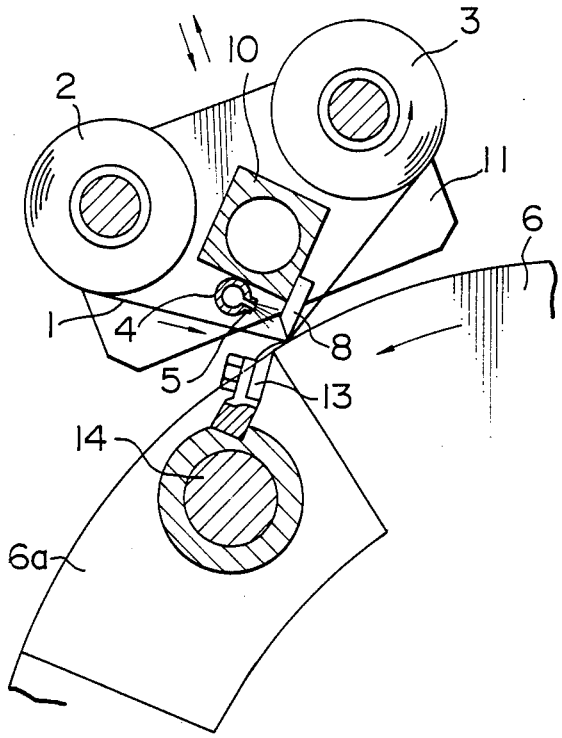
FIG. 7 is a cross sectional side view, similar to that of FIG. 5, showing the arrangement of the cleaning device in contact with the impression cylinder to be cleaned.

As a shifting mechanism or method for shifting the cleaning device inclusive of the pressing means from the grippers of the impression cylinder, is considered a mechanism or method for shifting the whole cleaning device and only the pressing means, but since the shifting principles of both the cases are substantially the same, the mechanism or method for shifting only the whole cleaning device will be described hereunder in conjunction with FIGS. 7 through 9.

In one example, the cleaning device is shifted at the gripper portion while detecting the rotation of the impression cylinder 6 is detected and then converted into electric current or voltage, whereby the position of the grippers 13 of the rotating impression cylinder 6 is obtained as an angular information by detecting the voltage (or current) variation by means of a rotary encoder, a proximity switch, a photoelectric switch, a mark sensor, a photointeracter, a limit sensor, or the like. The position of the grippers 13 may be detected directly by locating a switch or a sensor near the impression cylinder 6.

In another example, in which the cleaning device is shifted without detecting the rotation of the impression cylinder, at least two cams are located near the grippers 13 so as to cover the same thereby to avoid the direct contact of the cleaning device with the grippers 13. As shown in FIGS. 8 and 9, the direct contact between the cleaning device and the grippers of the impression cylinder may be avoided by locating cam means 18 on the shaft of the impression cylinder 6. For example, as shown in FIG. 9 as a side view of FIG. 8, the cam 18 mounted on the shaft of the impression cylinder 6 is positioned so as to accord with the positions of the grippers 13 located in the impression cylinder 6, and a mechanism 32 for moving the cleaning device is disposed in association with the cam 18 so as to operate in a manner such that, during the rotation of the impression cylinder 6, the lower front end of the mechanism 32 is usually engaged with the outer surface of the impression cylinder shaft 34 with the cleaning device unlifted and when the front end thereof is strunded on the cam 18, the mechanism 32 is moved upwardly and hence the cleaning device engaged with the upper end of the mechanism 32 is slightly raised. Accordingly, since the position of the cam 18 accords with those of the grippers 13, the cleaning device is in a raised position when the grippers 13 come into contact with the cleaning cloth. In actual operation of this embodiment, however, a spring means 33 is interposed in the mechanism 32 such as shown in FIG. 9, so that the lower edge of the blade 8 attached to the cleaning device can maintain a soft press of the cleaning cloth against the impression cylinder, i.e. the gripper portions thereof. Furthermore, it may be possible to shift the cleaning device periodically with a constant time interval by taking the rotating time of the impression cylinder into consideration.

In this preferred modification of this invention, the actual constructions and operations of the cleaning device and the associated members and units are substantially the same as those described hereinbefore with respect to the former embodiments. Particularly, in this modification, the cleaning device is constructed so as to avoid the direct contact with the projection (i.e. grippers) of the impression cylinder by means of an escape mechanism such as shown in FIG. 9.

Figure 8:
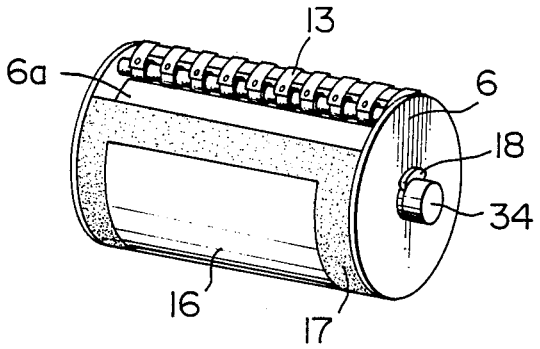
FIG. 8 is a perspective view of the impression cylinder with the grippers located therein.

In FIG. 8, reference numeral 16 designates a paper sheet applied to the impression cylinder and reference numeral 17 designates a spoiled portion thereof.

According to this embodiment, in which the damage of the cleaning device in direct contact with the grippers of the impression cylinder can be effectively avoided, the cleaning operation can be automatically and substantially completely performed without dangerous manual operation. This results in the reduction of the working time and the improvement of the production efficiency of the offset sheet-fed press.

Figure 9:
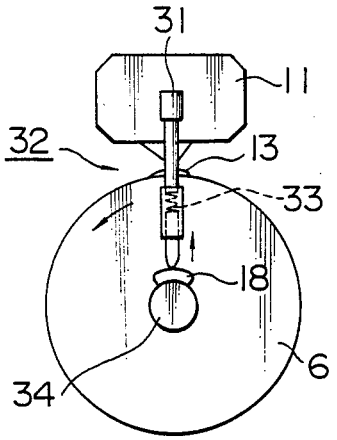
FIG. 9 is a brief side view of the impression cylinder shown in FIG. 8 provided with a cleaning device lifting mechanism.

With the foregoing embodiments and modification thereof of this invention, although a blade member is effectively utilized as a cleaning cloth pressing means, in a preferred modification shown in FIG. 9, the cleaning effect can be highly improved by providing a cleaning cloth guide member.

Figure 10:
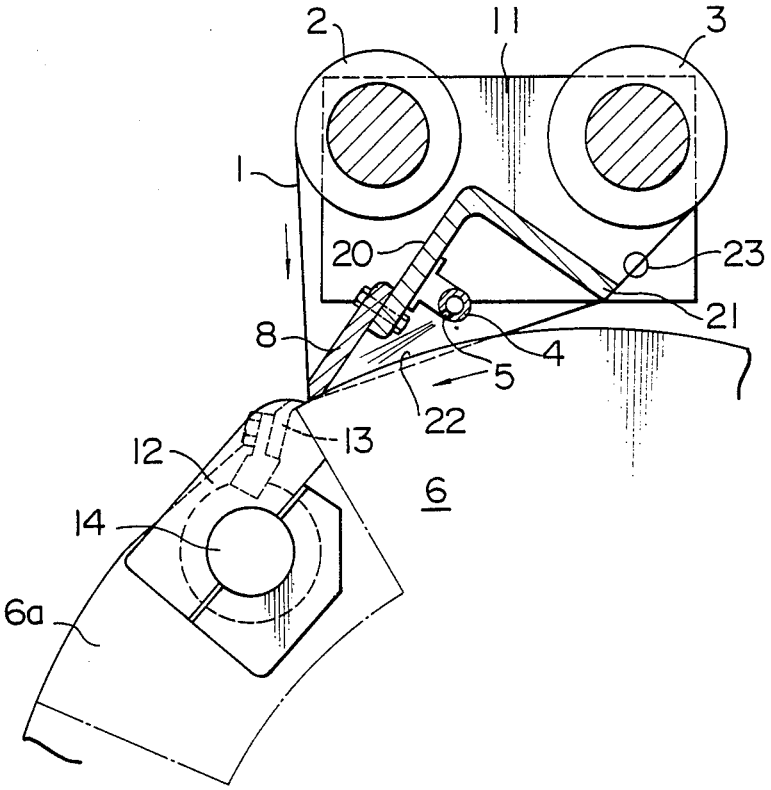
FIG. 10 is a cross sectional side view of a cleaning device according to this invention in association with the impression cylinder to be cleaned.

Referring to FIG. 10, an angle member 20 is attached to the frame 11 so that the opened portion is directed towards the impression cylinder 6, and to one edge of the angle member 20 is secured the blade 8 by fastening means such as bolts, and the other edge of the angle member 20 acts as a guide 21 for guiding the cleaning cloth 1. The angle member 20 is supported by the frame 11 so that the cleaning cloth 1 can be moved along an arcuate circumferential surface 22 of the impression cylinder 6 between the front edge of the blade 8 and the guide portion 21 of the angle member 20. The cleaning liquid supply unit comprising the supply pipe 4 provided with nozzles 5 is secured to the angled member 20 at a position suitable for jetting the cleaning liquid on the cleaning cloth 1 moving along the arcuate portion 22. The unit may be of course attached to the frame 11.

According to this arrangement, the cleaning cloth 1 pressed by the blade 8 can be guided along the surface of the escape cams 12, details of which are described hereinbefore, to thereby avoide the direct contact between the cleaning cloth 1 and the grippers 13, and moreover, the cleaning cloth 1 can be guided along the arcuate surface 22 of the impression cylinder 6, so that there is no fear of re-transferring of the smudge of the impression cylinder, thus highly improving the cleaning effect.

In an alteration, instead of the angle member 20, it may be possible to locate the blade 8 and a guide member as independent members at positions suitable for guiding the cleaning cloth 1 therebetween along the arcuate surface 22 of the impression cylinder 6.

Reference numeral 23 designates a pivot for rotating the frame 11 thereabout to remove the same from the impression cylinder 6.

According to this modification, since the cleaning cloth is pressed by the blade and the guide member so as to contact the cleaning cloth along the arcuate circumferential surface of the impression cylinder, evenly distributed pressing force can be applied to the cleaning cloth throughout the axial length of the impression cylinder, thus preventing unevenness of the applied pressure and improving the cleaning effect in comparison with the use of only the blade member. This effect will also be improved by providing the cam means to the impression cylinder to cover the grippers thereof and feeding the cleaning cloth while avoiding the direct contact between the grippers and the cleaning cloth.

In summary, according to the preferred embodiments described hereinbefore with reference to the accompanying drawings, the location of the blade member as a cleaning cloth pressing means instead of a conventional one such as pneumatic pressing pad reduces the contact area between the cleaning cloth and a cylinder, such as impression cylinder of an offset press, thus reducing the friction force therebetween and making compact the whole structure of a cleaning device. In addition, this cleaning effect can be highly improved by the location of cam means in combination of hook-shaped paper grippers of the impression cylinder to be cleaned, and the location of the cam means covering the grippers prevents the cleaning cloth from directly contacting the grippers. These characteristic features result in the improvement of the cleaning efficiency, the reduction of operation times and the compact and simplified structure of the cleaning device and hence the whole structure of the press.

The invention has been described in detail with particular reference to the preferred embodiments thereof, but it will be understood by those skilled in the art that various variations and modifications can be effected within the sprit and scope of the invention as described hereinabove and as defined in the appended claims.

What is claimed is:

1. A device for cleaning an impression cylinder of an offset, sheet-fed printing press, comprising:

a support frame;

a magazine roll around which a cleaning cloth is wound, said magazine roll having a rotation shaft supported by said support frame;

a take-up roll around which a used cleaning cloth is taken up, said take-up roll having a rotation shaft supported by said support frame;

pressing means comprising a blade member attached to said support frame at a portion between said magazine roll and said take-up roll and pressing said cleaning cloth against the impression cylinder to be cleaned, said blade member pressing said cleaning cloth against said cylinder in substantially a line contact along the length of said blade;

means attached to said support frame for supplying cleaning liquid to said cleaning cloth; and means for moving said support frame away from said impression cylinder, said means comprising sheet holding grippers provided on said impression cylinder and projecting over a peripheral surface of said impression cylinder, and means for detecting a predetermined angular position of said impression cylinder and moving said pressing means away from said impression cylinder, thereby preventing said grippers from directly contacting said cleaning cloth.

2. The device of claim 1, wherein said blade member comprises a front edge which contacts said cleaning cloth at an angle of about 20°-60°.

3. The device of claim 1, wherein said pressing means comprises an angled member attached to said support frame and having an opening toward said impression cylinder to be cleaned, said angled member having one end to which said blade member for pressing said cleaning cloth against said impression cylinder is fixed and another end serving as a guide member for guide said cleaning cloth to move along an arcuate surface of the impression cylinder to be cleaned.

4. A device for cleaning an impression cylinder of an offset, sheet-fed printing press, comprising:

a support frame;

a magazine roll around which a cleaning cloth is wound, said magazine roll having a rotation shaft supported by said support frame;

a take-up roll around which a used cleaning cloth is taken up, said take-up roll having a rotation shaft supported by said support frame;

pressing means comprising a blade member attached to said support frame at a portion between said magazine roll and said take-up roll and pressing said cleaning cloth against the impression cylinder to be cleaned, said blade member pressing said cleaning cloth against said cylinder in substantially a line contact along the length of said blade;

means attached to said support frame for supplying cleaning liquid to said cleaning cloth; and means for moving said support frame away from said impression cylinder, said means comprising sheet holding grippers provided on said impression cylinder and projecting over a peripheral surface of said impression cylinder, and cam means attached to a gripper shaft on which said grippers are mounted, said cam means comprising at least two escape cams having an outer configuration larger than that of said grippers, thereby preventing said grippers from directly connecting said cleaning cloth.

5. The device of claim 4, wherein said blade member comprises a front end which contacts said cleaning cloth at an angle of about 20°-60°.

6. The device of claim 4, wherein said pressing means comprises an angled member attached to said support frame and having an opening toward said impression cylinder to be cleaned, said angled member having one end to which said blade member for pressing said cleaning cloth against said impression cylinder is fixed and another end serving as a guide member for guiding said cleaning cloth to move along an arcuate surface of the impression cylinder to be cleaned.

* * * * *